US010427861B2

(12) United States Patent
Webster

(10) Patent No.: US 10,427,861 B2
(45) Date of Patent: Oct. 1, 2019

(54) DISPENSING CONTAINER FOR BLISTER PACK OF MEDICATION

(71) Applicant: Manrex Limited, Winnipeg (CA)

(72) Inventor: John L. Webster, Winnipeg (CA)

(73) Assignee: Manrex Limited, Winnipeg, MB (CA)

( * ) Notice: Subject to any disclaimer, the term of this patent is extended or adjusted under 35 U.S.C. 154(b) by 807 days.

(21) Appl. No.: 15/052,225

(22) Filed: Feb. 24, 2016

(65) Prior Publication Data

US 2016/0288984 A1 Oct. 6, 2016

Related U.S. Application Data

(60) Provisional application No. 62/140,015, filed on Mar. 30, 2015.

(51) Int. Cl.

| | |
|---|---|
| ***A61J 1/00*** | (2006.01) |
| ***B65D 83/04*** | (2006.01) |
| ***A61J 1/16*** | (2006.01) |
| ***A61J 7/00*** | (2006.01) |
| *A61J 1/03* | (2006.01) |

(52) U.S. Cl.

CPC ..... *B65D 83/0463* (2013.01); *A61J 1/16* (2013.01); *A61J 7/0076* (2013.01); *A61J 1/035* (2013.01)

(58) Field of Classification Search

CPC ..... A45C 11/00; A45C 2011/003; A45C 2011/002; A45C 5/00; H04B 1/3888; H04K 5/03; H04K 5/0217

USPC ..... 206/531, 1.5, 539, 530, 538

See application file for complete search history.

(56) References Cited

U.S. PATENT DOCUMENTS

| | | | | |
|---|---|---|---|---|
| 4,502,612 A * | 3/1985 | Morrison | B65D 63/109 | 206/540 |
| 5,035,237 A * | 7/1991 | Newell | A61M 15/0045 | 128/203.15 |
| 6,155,424 A * | 12/2000 | Dubach | B65D 83/0463 | 206/531 |
| 6,206,235 B1 * | 3/2001 | Green | B65D 83/0409 | 221/204 |
| 6,941,728 B1 * | 9/2005 | Bray | B65B 19/20 | 53/234 |
| 7,159,717 B2 * | 1/2007 | Aldridge | B65D 5/009 | 206/271 |
| 7,431,160 B2 * | 10/2008 | Drought | A61J 1/035 | 206/528 |

(Continued)

*Primary Examiner* — Ernesto A Grano

(74) *Attorney, Agent, or Firm* — Adrian D. Battison; Ade & Company Inc; Kyle R. Satterthwaiter

(57) ABSTRACT

A dispensing container for a medication blister pack is formed of a front holder portion having a plurality of openings aligned with the blisters and a rear catching container snap fastened to the holder portion to catch and hold medications which can be released by the user operating a flap. The catching container includes an integrally molded leg portion hinged thereon for movement to extend rearwardly to support the container in an upstanding position from a horizontal support surface. The holder portion is formed as a separate molded portion defining a front face of the dispensing container at which the blister pack is exposed with top and bottom edges each forming a slot defined between the panel and an overlying component so as to allow the blister pack slide along the panel to lie on the panel with the top and bottom edges trapped by the slots.

19 Claims, 7 Drawing Sheets

(56) References Cited

U.S. PATENT DOCUMENTS

| | | | | |
|---|---|---|---|---|
| 7,481,331 | B2 * | 1/2009 | Webster | B65D 83/0463 221/25 |
| 7,617,935 | B2 * | 11/2009 | Reilley | A61J 7/00 206/1.5 |
| 7,841,575 | B1 * | 11/2010 | Sliger | F16M 11/10 248/454 |
| 8,231,099 | B2 * | 7/2012 | Chen | F16M 11/10 248/461 |
| 8,746,454 | B2 * | 6/2014 | Doucet | B65D 83/0463 206/531 |
| 9,108,784 | B2 * | 8/2015 | Pipes | A61J 1/035 |
| 2003/0042167 | A1 * | 3/2003 | Balz | B65D 83/0463 206/531 |
| 2004/0094566 | A1 * | 5/2004 | Renaud | B65D 83/0409 221/266 |
| 2005/0082194 | A1 * | 4/2005 | Fry | A61J 1/035 206/531 |
| 2007/0075208 | A1 * | 4/2007 | Chen | F16M 11/10 248/455 |
| 2007/0164191 | A1 * | 7/2007 | Kim | F16C 11/10 248/686 |
| 2008/0230556 | A1 * | 9/2008 | Kroupa | B65D 25/22 221/256 |
| 2009/0095649 | A1 * | 4/2009 | Costa | B65D 83/0463 206/530 |
| 2013/0220870 | A1 * | 8/2013 | Grosskopf | A61J 1/035 206/531 |
| 2014/0326636 | A1 * | 11/2014 | Baschnagel | A61J 1/03 206/538 |
| 2016/0033074 | A1 * | 2/2016 | Drakos | F16M 11/041 248/122.1 |
| 2018/0167498 | A1 * | 6/2018 | Drakos | F16M 11/105 |

* cited by examiner

DISPENSING CONTAINER FOR BLISTER PACK OF MEDICATION

This application claims the benefit under 35 USC 119(e) of Provisional application 62/140015 filed Mar. 30, 2015.

This invention relates to a vertically mounted, gravity fed dispensing container for containing a blister pack of medications by which the medications in the blister pack can be ejected from the blister pack for dispensing to a patient, or, for self-administration.

BACKGROUND OF THE INVENTION

Medications are commonly delivered in what are known as "blister packs" in which medications are placed in a series of blisters and then sealed on the other side by a foil layer. The medications are thus maintained in properly supported position in a hygienic manner in the individual blisters and held in place by the foil layer. In some, but not all cases, support is provided by a cardboard backing/overlay, formed of card which can then include printed information or other written information which identifies the medication and/or the patient.

Various designs and arrangements of such blister packs have previously been proposed including the different shaping of the openings and therefore of the blisters to provide particular effects. In particular Canadian Patent 1,310,936 assigned to the present applicant there is disclosed a blister pack of this type in which the openings are arranged in a matrix of seven rows and four columns providing four blisters each of which can be used for a respective day of the week with four medication administration times as defined by the rows, or, by four weeks of seven days for a single specific medication administration time. Thus a patient taking medications four times a day can be supplied with a blister pack of this type in which the medications for each time of day and for each day of the week are set out in the individual blisters.

Blister packs of this type therefore make the medications properly available to the patient so that the patient can be ensured that they have taken the proper medications at the proper time. Reminders can be provided and the patient will be readily aware if a medication has been omitted since the medications not taken will remain in the blister pack.

A critical issue, however, is proper storage and convenient placement of the blister packs to ensure the medications are taken and not forgotten remains an open problem in that they merely may be discarded within the patients home. By not being stored in a consistent location or by being placed in an inconvenient location, or readily supported for the convenience of the patient or for the convenience of a caregiver looking after the patient may lead to medication non-compliance and a serious and potentially dangerous situation.

In addition, poor or improper storage may lead to medication degradation, or provide easy access for individuals not intended for the medications.

A number of different designs have been proposed of devices for holding blister packs and/or expelling of medications from blister packs.

In U.S. Pat. No. 7,481,331(Webster) issued Jan. 27, 2009 is disclosed a wall mounted gravity fed container for use with a blister pack where the medications are pushed from the pack on a holder portion into a catching container where the medications drop to a bottom flap valve to be operated by the user to discharge the medications into a cup.

In U.S. Pat. No. 5,109,984 (Romick) issued May 5, 1992 is disclosed a holder for blister packs with two overlying sheets between which the blister pack is retained with each sheet having opening aligned with the blisters by which the medications can be expelled though the openings. A cover extends over one of the sheets.

In U.S. Pat. No. 6,651,840 (Van Dulleman) issued Nov. 25, 2003 is disclosed a holder for a blister pack where the blister pack is annular and the holder defines a housing surrounding the outside of the blister pack with a dispensing plunger inside the annulus of the blister pack to expel the medications outwardly though an opening in the outer housing so that the medication when expelled from the blister falls directly through the opening. The plunger and opening are rotated relative to the blister pack to select one of the blisters for expulsion of the medication.

In U.S. Pat. No. 5,348,158 (Honan) issued Sep. 20, 1994 is disclosed a holder for a blister pack where the blister pack is rectangular and the holder defines a corresponding shaped housing with a-top and bottom and with a dispensing plunger at the top of the blister pack to expel the medications downwardly though the bottom so that the medication when expelled from the blister falls directly through a bottom opening. The plunger is movable along an S-shaped track across the top of the housing to interact with each blister in turn.

In U.S. Pat. No. 5,368,187 (Poncetta) issued Nov. 29, 1994 is disclosed a dispenser for simultaneously dispensing medications from a stack of parallel, horizontal, overlying blister packs where a dispensing plunger with a cutter at the top of the blister pack stack is driven downwardly through an aligned column of the blisters of stack to expel the medications downwardly into a bottom container.

In U.S. Pat. No. 6,318,051 (Preiss) issued Nov. 20, 2001 is disclosed an automated system for expelling medications from blister packs using a vertically movable plunger which pushes downwardly through the blister pack to expel the medication into a tray below the blister pack.

SUMMARY OF THE INVENTION

It is one object of the invention to provide a dispensing container for holding blister packs of medications which assist the user in conveniently storing the blister pack and dispensing the medications therefrom.

According to one aspect of the invention there is provided a dispensing container for use with a blister pack having a series of blisters each containing a dose of one or more medications which can be expelled from the blisters by a user for use of the medication, the dispensing container comprising:

a holder portion for receiving and supporting the blister pack;

the holder portion having a plurality of openings therein arranged to be aligned with the blisters in the blister pack such that the medication in each blister can be expelled from the blister through the opening;

a catching container fixed to the holder portion adjacent the holder portion such that medication expelled from the blisters through the openings is caught and held in the catching container;

a dispensing opening in the catching container arranged such that the medication caught and held in the catching container is discharged by the user from the catching container through the dispensing opening when required;

wherein the catching container includes a leg portion movable between a first position, in which the leg portion is retained against a rear of the container so that the container provides a rear face which can be fastened to a vertical support surface, and a second position in which the leg portion extends rearwardly to support the container in an upstanding position from a horizontal support surface.

Preferably the catching container is arranged such that, with the dispensing container mounted on a vertical wall surface, the holder portion mounts the blister pack vertically with the catching container behind the blister pack and the dispensing opening at a bottom wall of the catching container Preferably there is provided a valve in the form of a flexible flap operable by the user at the dispensing opening arranged such that the medication is held by the valve in the catching container at the discharge opening, the valve being operable by the user to release the medication from the dispensing opening.

Preferably there is provided a wall mounting arrangement such as key-hole screw openings on a flange which is attached on a rear face of the catching container.

Preferably the holder portion comprises a first molded portion and the catching container comprises a second molded portion which is arranged to snap onto the holder portion so that the assembly is formed simply and inexpensively from two simple molded parts with all components forming part of those molded parts. That is preferably the holder portion and the catching container are formed as separate molded portions.

Preferably the leg portion extends in the second position rearwardly and downwardly from a position on the container spaced from a bottom of the container so that the container stands on the leg and the bottom end so that the front face of the container is inclined upwardly and rearwardly from the horizontal support surface or table top.

Thus for example the leg portion is hinged to the container as an integral part of the catching container and is hinged by a flexible connection with the catching container.

Preferably the integrally molded leg portion is generally U-shaped so as to comprise a pair of leg members connected at ends to the catching container with a cross-member between the legs for engaging the horizontal support surface the legs lie along respective sides of the catching container.

Preferably the holder portion comprises a panel for receiving the blister pack where the panel contains the plurality of openings forming an array thereon and the holder portion has, at top and bottom edges thereof, a slot defined between the panel and an overlying component so as to allow the blister pack to lie on the panel with the top and bottom edges trapped by the slots.

Preferably in this arrangement the panel has a raised rib along a first side edge to butt against a side edge of the blister pack and the panel is open to a second side edge of the holder portion to allow the blister pack to slide across the panel from the second side edge while the top and bottom edges slide in the slots.

According to a second aspect of the invention there is provided a dispensing container for use with a blister pack having a series of blisters each containing a dose of one or more medications which can be expelled from the blisters by a user for use of the medication, the dispensing container comprising:

a holder portion for receiving and supporting the blister pack;

the holder portion having a plurality of openings therein arranged to be aligned with the blisters in the blister pack such that the medication in each blister can be expelled from the blister through the opening;

a catching container fixed to the holder portion adjacent the holder portion such that medication expelled from the blisters through the openings is caught and held in the catching container;

a dispensing opening in the catching container arranged such that the medication caught and held in the catching container is discharged by the user from the catching container through the dispensing opening when required;

wherein the holder portion comprises a panel for receiving the blister pack where the panel contains said plurality of openings forming an array thereon;

and wherein the holder portion has at top and bottom edges thereof a slot defined between the panel and an overlying component so as to allow the blister pack to lie on the panel with the top and bottom edges trapped by the slots.

In this arrangement preferably the panel has a raised rib along a first side edge to butt against a side edge of the blister pack and the panel is open to a second side edge of the holder portion to allow the blister pack to slide across the panel from the second side edge while the top and bottom edges slide in the slots.

According to a third aspect of the invention there is provided a dispensing container for use with a blister pack having a series of blisters each containing a dose of one or more medications which can be expelled from the blisters by a user for use of the medication, the dispensing container comprising:

a holder portion for receiving and supporting the blister pack;

the holder portion having a plurality of openings therein arranged to be aligned with the blisters in the blister pack such that the medication in each blister can be expelled from the blister through the opening;

a catching container fixed to the holder portion adjacent the holder portion such that medication expelled from the blisters through the openings is caught and held in the catching container;

a dispensing opening in the catching container arranged such that the medication caught and held in the catching container is discharged by the user from the catching container through the dispensing opening when required;

the holder portion comprising a first molded portion defining a front face of the dispensing container at which the blister pack is exposed;

the catching container comprising a second molded portion attached to the holder portion behind the holder portion;

so that the dispensing container is formed wholly by the first molded portion and the second molded portion.

Preferably in this arrangement there is provided a valve at the dispensing opening arranged such that the medication is held by the valve in the catching container at the discharge opening; the valve being operable by the user to release the medication from the dispensing opening where the valve is a flexible component of one of the first and second molded portions.

Preferably in this arrangement the container includes a leg portion movable to support the container in an upstanding position and wherein the leg is a flexible component of one of the first and second molded portions.

BRIEF DESCRIPTION OF THE DRAWINGS

One embodiment of the invention will now be described in conjunction with the accompanying drawings in which:

FIG. 4 is a cross-sectional view along the lines 4-4 of the container of

FIG. 1.

In the drawings like characters of reference indicate corresponding parts in the different figures.

DETAILED DESCRIPTION

Figure 1:
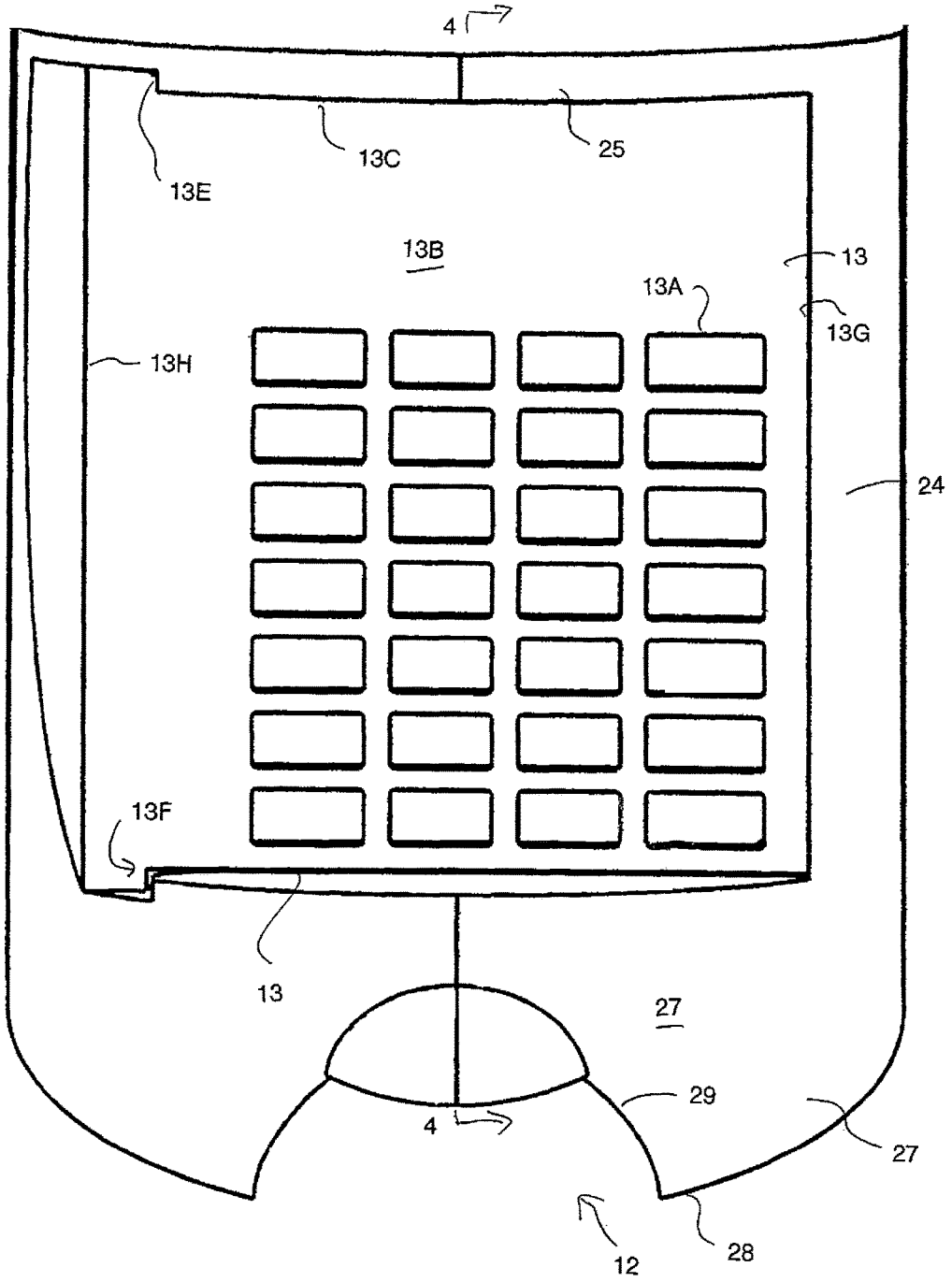
FIG. 1 is a front elevational view of a dispensing container for medication compliance cards according to the present invention.

The container 12 shown in the figures comprises a rear container portion 10 and a front container portion 11 which are snap fastened together by suitable coupling elements of a type well known to a person skilled the plastic molding industry. The container portions 10 and 11 are each formed separately as an integrally molded element using conventionally known techniques.

A blister sheet 31 of a conventional type for containing the medications to be dispensed is a separate element from the container and comprises a foil layer 31B and a blister sheet 31C. Blister packs of this type are of course well known as described above. The blister sheet may include a stiffening card but these are optional and one is not shown in the figures.

The blister sheet 31 is carried on a front face panel 13 of the front container portion 11 and the number and arrangement of the blisters is equal to the number and arrangement of openings 13A in the front panel. Thus the blister pack covers the front panel and matches the openings so that the blisters are exposed in front of the front panel.

A particularly preferred arrangement utilizes the layout of the blister pack as shown in the above Canadian patent where the blisters are arranged in a matrix of seven rows and four columns and in particular the first and fourth columns have the blisters thereof slightly larger in width than the blisters of the second and third columns. In this way a larger amount of medication can be contained within the first and fourth columns. However the invention is certainly NOT limited to a particular array (4×7) of the blisters and other shapes of the array could be included.

Behind the front panel 13, the rear container portion 10 defines a chamber 14 which is generally rectangular and formed at its rear by a rear wall 15, at its front by the panel 13, at its top by a top wall 16, at its sides by the side walls 17 and 18 and its bottom by a bottom wall 19, all of which form part of the rear container portion 10 and project forwardly from the flat rear wall 15. The chamber 14 has a sufficient width W so that medications expelled from the blisters by pushing on the blisters rearwardly can be received within the chamber 14. Thus the medications, regardless of which blister is depressed for expelling the medications, collects the medications within the chamber 14. Thus the medications expelled from the blisters fall downwardly in the chamber 14 to the bottom wall 19.

The bottom wall 19 of the chamber includes a central chute 20 with a bottom mouth 21. The chamber 14 and the bottom wall 19 are shaped so that any medications, regardless of the blister from where they came, fall to the bottom wall and then move by a shaping of the bottom wall into the chute 20 to collect at the mouth 21. Thus when the user depresses a blister, the medications are expelled and tumble to the bottom for collection at the mouth 21 of the chute.

The mouth 21 is closed by a flap 23 which extends across the mouth so that the medications at the mouth 21 fall onto the flap 23 and remain within the chute until the user is ready to receive the medications. The flap 23 is an integral flexible part of either the front portion 11 or the rear portion 12 which can be readily flexed by a finger or a cup of the user. Thus the user can place a receptacle such as a cup against the flexible flap and apply pressure so that it pivots rearwardly about a designed and integral hinge member 24 which pivots the flap 23 away from the mouth allowing the medications to be released from the mouth 21. The user, who may be infirm, can readily place a cup in the required position under the mouth 21 and can apply sufficient pressure to release the medications when the user is ready to receive those medications. The flap 23 is preferably formed integrally with the rear portion 10, from a memory plastics material so that it recovers to the closed position when the pressure by the user is released.

The user therefore has an extended period of time after the medications are punched from the blister to move to the next step in the process of picking up the cup or receptacle and moving it to flap to release the medications from the chute 20. These actions can therefore be carried out as two separate steps with the user being able to concentrate initially on punching the required blister and only after this is carried out can concentrate upon collecting the medications for use.

Thus as shown in the Figures, the arrangement herein provides a dispensing container 10 for use with a blister pack 31 having a series of blisters 32 each containing a dose 33 of one or more medications which can be expelled from the blisters 32 by a user for use of the medication by the user depressing the blister by a finger or a punch thus depressing he blister and forcing the medication through the rear foil layer 31 B into the container 14.

The holder portion 11 defines the panel 13 which has the plurality of openings 13A therein arranged to be aligned with the blisters in the blister pack and a flat planar upper portion 13B which supports an upper area of the blister pack typically containing written data for the user.

The panel 13 for receiving the blister pack has at top and bottom edges 13C, 13D thereof slots 13E, 13F defined between the panel 13 and an overlying component 13G, 13H so as to allow the blister pack 31 to lie on the panel 13 with the top and bottom edges 31D, 31E of the blister pack 31 trapped by the slots.

The flat panel 13 on which the blister pack sits has a raised rib 24 along a first side edge 13G to butt against a side edge of the blister pack 31 and to hold it in place. The panel 13 is open to a second side edge 13H of the holder portion to allow the blister pack 31 to slide across the panel 13 from the second side edge 13H to butt against the edge 13G while the top and bottom edges 31D, 31E slide in the slots. Thus the slots have an entrance adjacent the edge 13H allowing the flat back of the blister pack to slide onto the panel 13 over the edge 13H.

The panel 13 is flat and connects to a top strip 25 of the front holder portion 11 across the top of the container 12. A bottom edge 26 of the top strip 25 forms an edge which cooperates with the upper part of the panel 13 to form the upper slot 13E. At the bottom of the front portion 11 is formed an arched section 27 which curves downwardly from the bottom edge of the panel 13 to a bottom edge 28 of the arched section.

Figure 2:
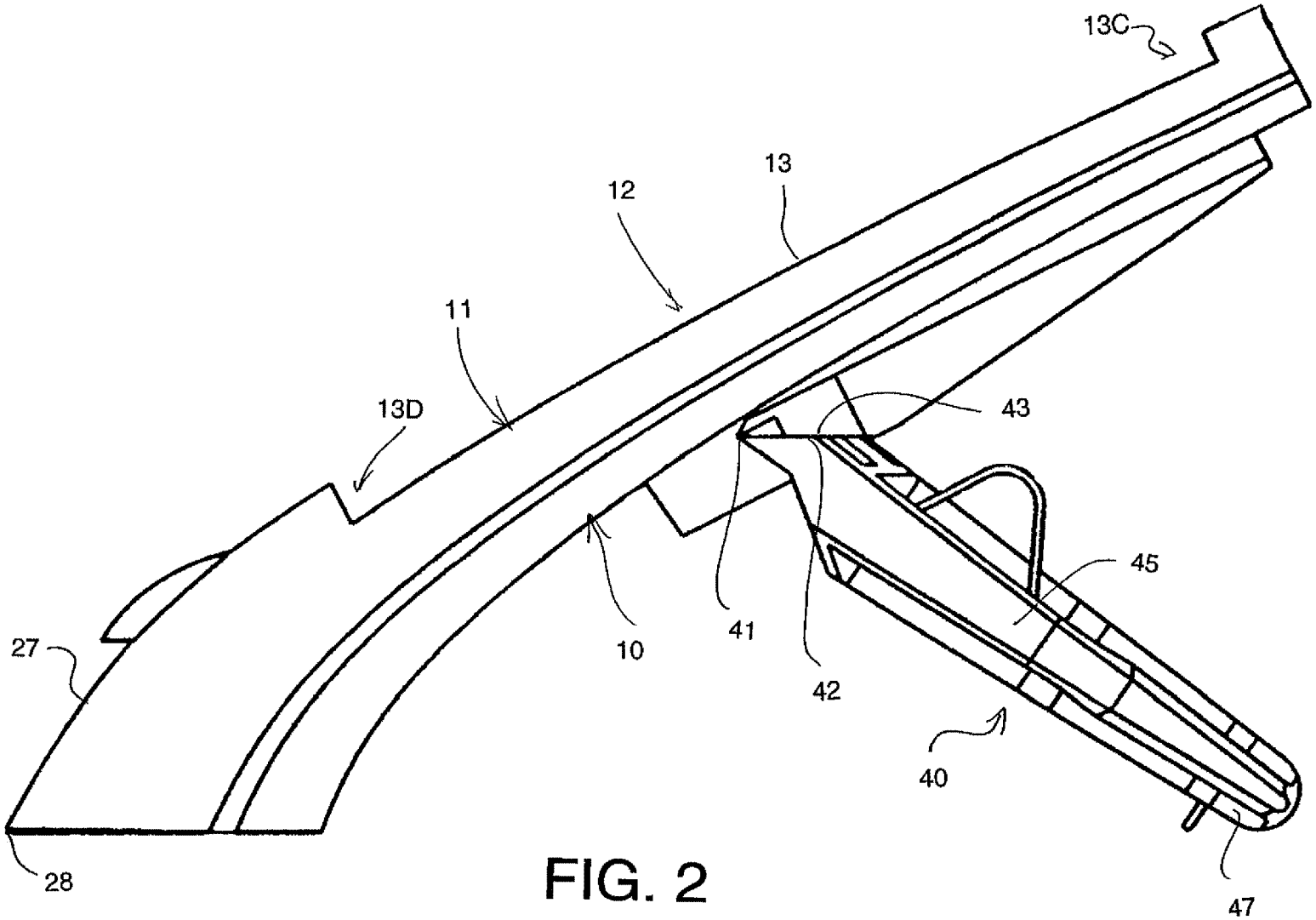
FIG. 2 is a side elevational view of the container of FIG. 1.
Figure 3:
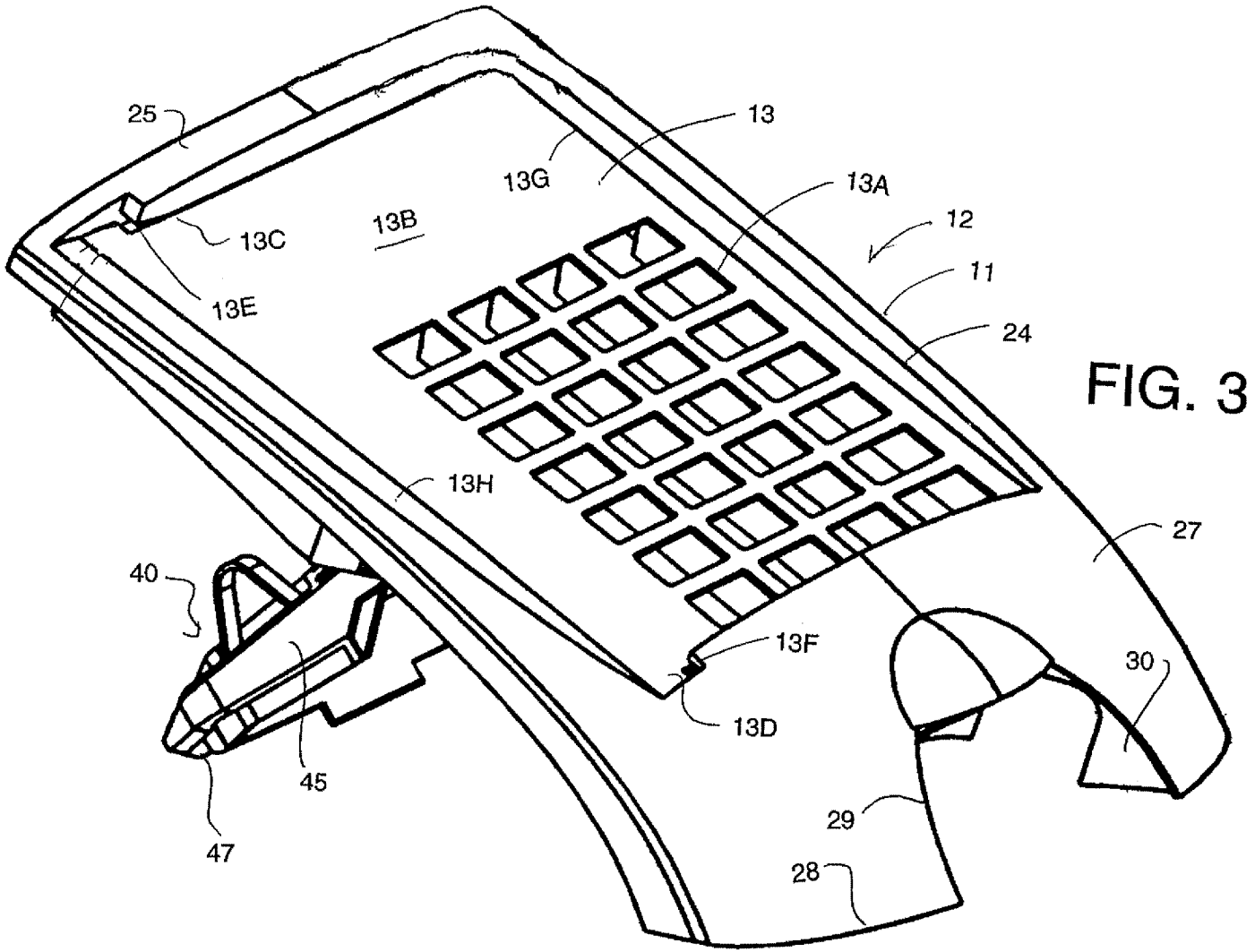
FIG. 3 is an isometric view of the container of FIG. 1.
Figure 4:
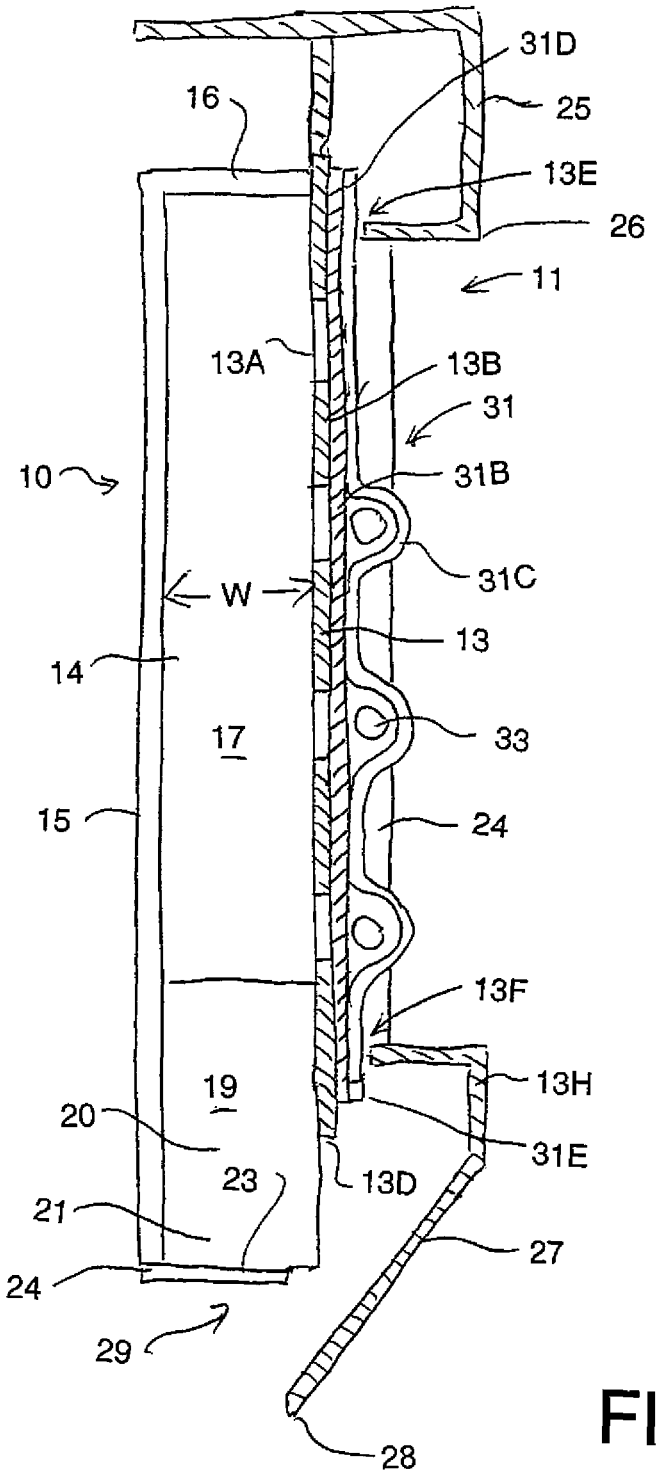
Figure 5:
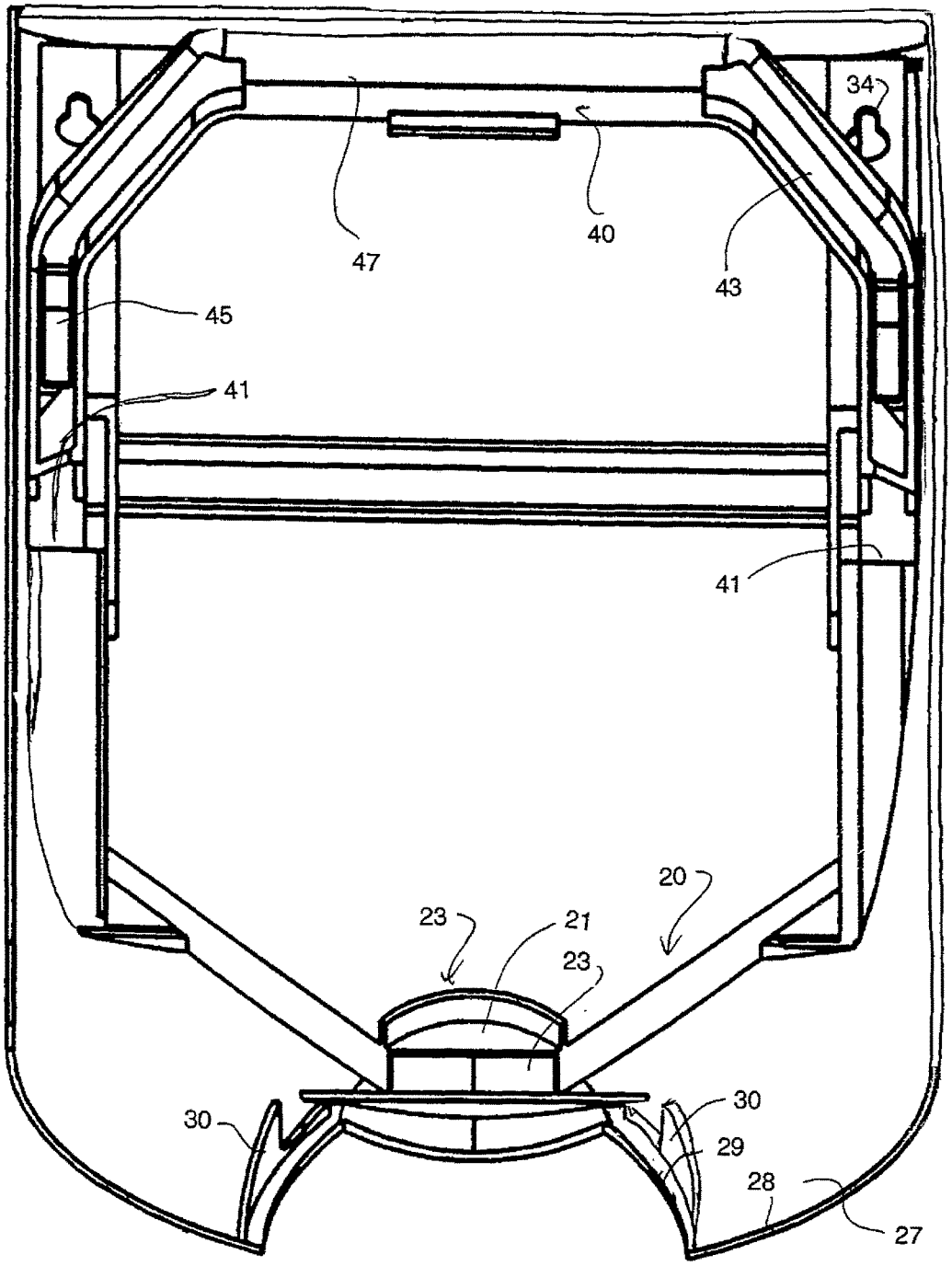
FIG. 5 is a rear elevational view of the container of FIG. 1.
Figure 6:
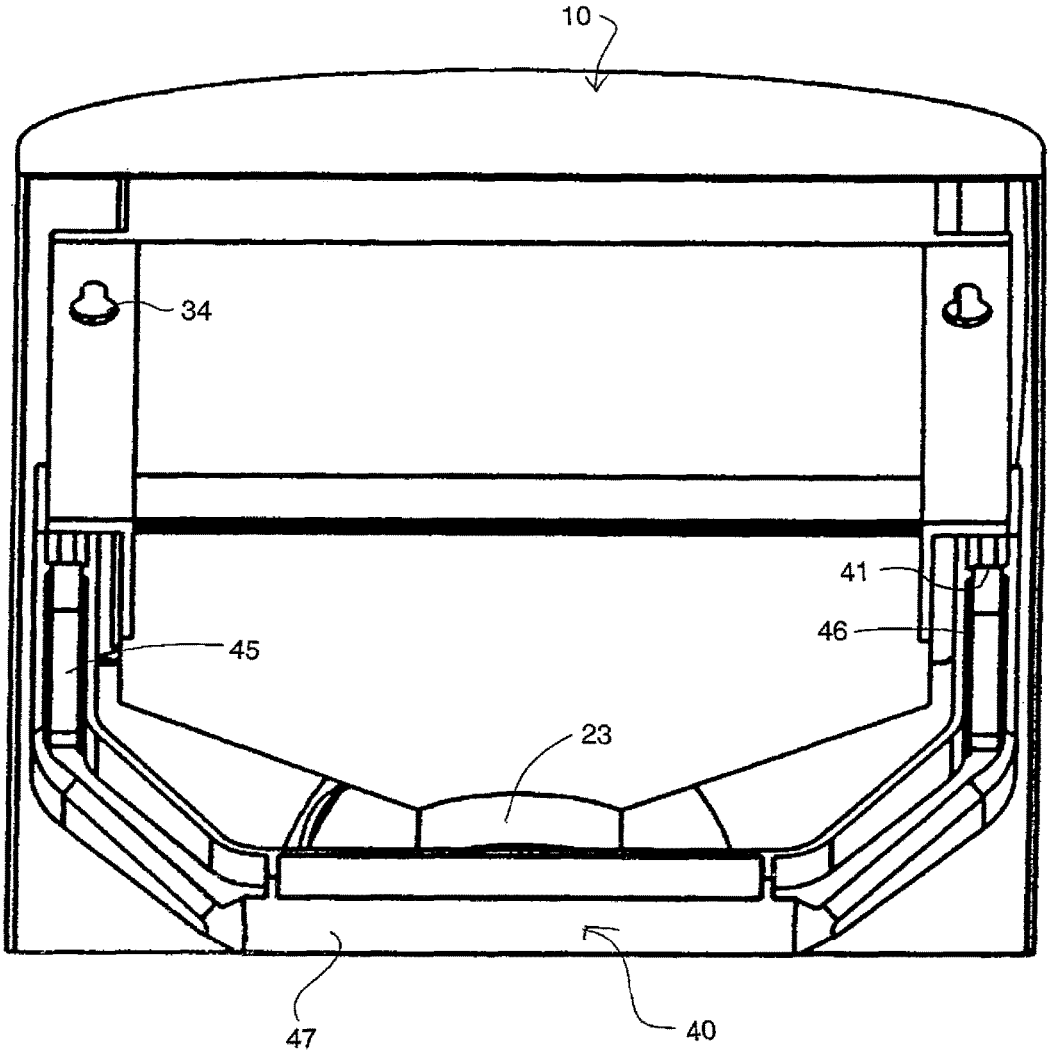
FIG. 6 is a rear elevational view of the container of FIG. 1 shown from the rear of FIG. 2.

The container is arranged either to sit on a table top surface as in FIGS. 2, 3 and 6 or to hang a vertical surface such as a wall as shown in FIGS. 1, 4, 5 and 7. In the arrangement of FIG. 3, the bottom edge 28 sits on the horizontal surface and includes rearwardly extending flanges 30 at side edges of a bottom opening 29 for stability of the bottom edge 28 on the surface. The bottom opening or recess 29 extends from the bottom edge 28 upwardly to the bottom of the chute 20 at the mouth 21 so that the user can present a cup in the recess 29 at the flap 23 to operate the flap valve and release the medication into the cup at the discharge opening 21.

As described previously the bottom portion 10 defines the catching container for the medication which is fixed to the holder portion 11 adjacent the holder portion such that medication expelled from the blisters through the openings is caught and held in the catching container. The dispensing opening 21 in the catching container 10 is arranged such that the medication caught and held in the catching container is discharged by the user from the catching container through the dispensing opening when required.

The dispensing container can be mounted on a vertical wall surface in which case the holder portion mounts the blister pack 31 vertically on the panel 13 with the catching container 14 behind the blister pack and the dispensing opening 21 at a bottom wall of the catching container 14.

Figure 7:
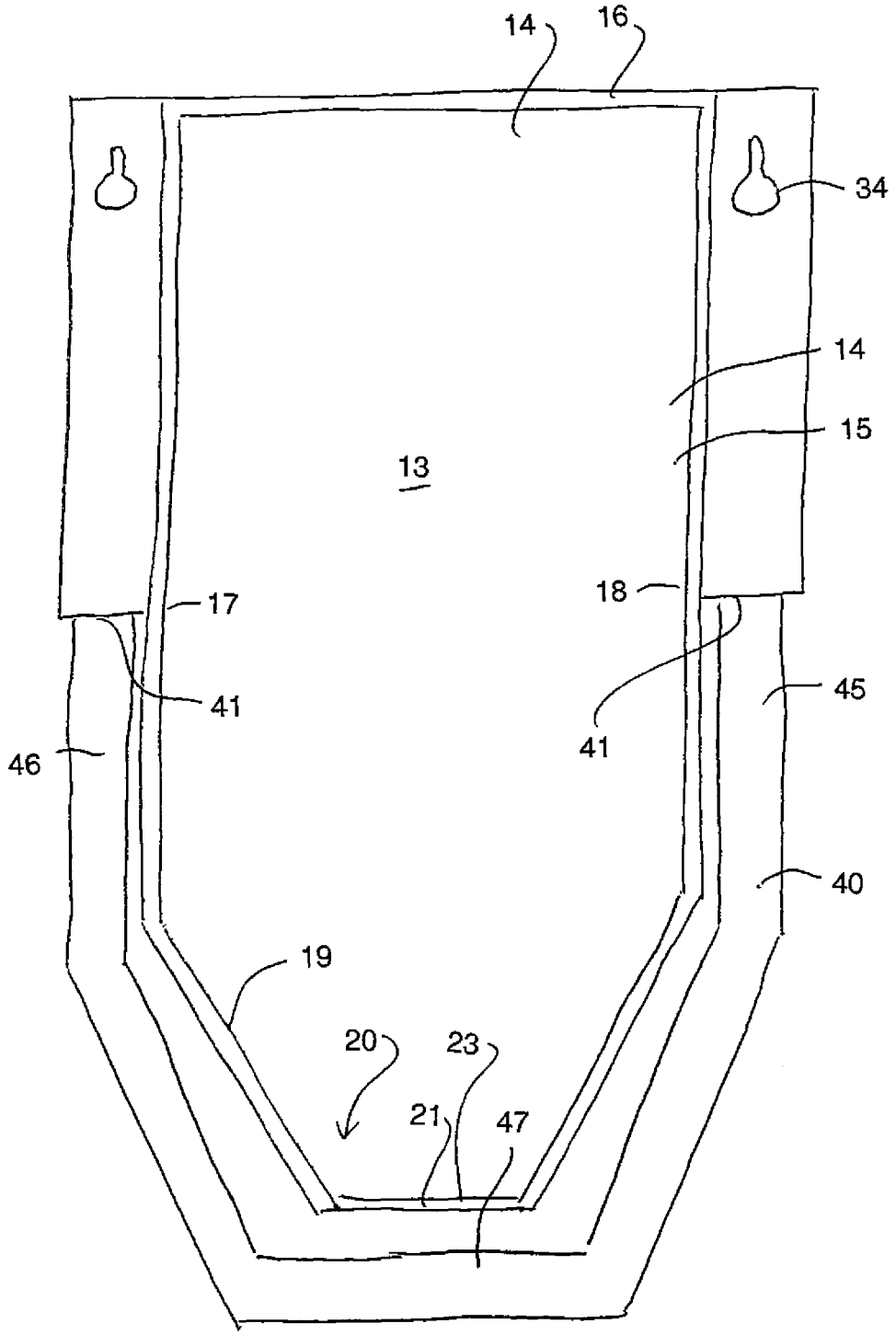
FIG. 7 is a front elevational view of the catching container portion of the container of FIG. 1 when separated from the holder portion.

The catching container also includes a leg portion 40 movable between a first position, in which the leg portion is retained against a rear of the container as shown in FIG. 7 so that the container provides a rear face which can be fastened to a vertical support surface using key hole openings 34 and a second position shown in FIGS. 2 and 3 in which the leg portion 40 extends rearwardly to support the container in an upstanding position from a horizontal table support surface. The leg portion is hinged at a flexible hinge 41 to the container at the rear portion 11. Thus the leg portion can extent along the back of the rear portion or can be moved to the hinge position shown in FIG. 2 where a face 42 of the leg portion butts against a face 43 of the rear portion 10. Thus the leg portion extends in the second position rearwardly and downwardly from a position at the hinge 41 on the container spaced from the bottom 28 of the container so that the container stands on the leg and the bottom end is inclined upwardly and rearwardly from the horizontal support surface.

The leg portion is formed integrally with the catching container and is hinged by a flexible connection 41 with the catching container. Thus the leg is formed as an integral part so that only two parts defined by the front portion and rear portions are provided separately as separate molded portions.

The leg portion is generally U-shaped so as to comprise a pair of leg members 45, 46 connected at ends to the catching container at the hinge 41 with a cross-member 47 between the legs for engaging the horizontal support surface. This allows the leg members 45, 46 to lie along respective sides of the catching container 14.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A dispensing container for use with a blister pack having a series of blisters each containing a dose of one or more medications which can be expelled from the blisters by a user for use of the medication, the dispensing container comprising:

a holder portion for receiving and supporting the blister pack;

the holder portion having a plurality of openings therein arranged to be aligned with the blisters in the blister pack such that the medication in each blister can be expelled from the blister through the opening;

a catching container fixed to the holder portion adjacent the holder portion such that medication expelled from the blisters through the openings is caught and held in the catching container;

a dispensing opening in the catching container arranged such that the medication caught and held in the catching container is discharged by the user from the catching container through the dispensing opening when required;

a leg portion movable between a first position, in which the leg portion is retained against a rear of the container so that the container provides a rear face which can be fastened to a vertical support surface, and a second position in which the leg portion extends rearwardly to support the container in an upstanding position from a horizontal support surface;

wherein the container has a bottom edge which rests on the horizontal support surface when the leg portion is in the second position;

and wherein the dispensing opening is located in a recess which extends from the bottom edge upwardly to the dispensing opening which is raised from the bottom edge so that a cup on the horizontal surface is presented into the recess at the dispensing opening to discharge the medication into the cup at the dispensing opening.

2. The dispensing container according to claim 1 wherein with the dispensing container mounted on a vertical wall surface the holder portion mounts the blister pack vertically with the catching container behind the blister pack and the dispensing opening at a bottom wall of the catching container.

3. The dispensing container according to claim 1 wherein there is provided a valve at the dispensing opening arranged such that the medication is held by the valve in the catching container at the discharge opening; the valve being operable by the user to release the medication from the dispensing opening.

4. The dispensing container according to claim 3 wherein the valve comprises a flap operable by the user to open the valve.

5. The dispensing container according to claim 1 wherein there is provided a wall mounting arrangement which is attached on a rear face of the catching container.

6. The dispensing container according to claim 1 wherein the holder portion comprises a first molded portion and the catching container comprises a second molded portion which is arranged to snap onto the holder portion.

7. The dispensing container according to claim 6 wherein the leg portion is hinged to the second molded portion.

8. The dispensing container according to claim 6 wherein the leg portion is formed integrally with the second molded portion and is hinged by a flexible connection with the second molded portion.

9. The dispensing container according to claim 6 wherein the holder portion and the second molded portion are formed as separate molded portions.

10. The dispensing container according to claim 6 wherein the leg portion is formed as part of the second molded portion.

11. The dispensing container according to claim 1 wherein the leg portion extends in the second position rearwardly and downwardly from a position on the container spaced from a bottom of the container so that the container stands on the leg and the bottom end is inclined upwardly and rearwardly from the horizontal support surface.

12. The dispensing container according to claim 1 wherein the leg portion is generally U-shaped so as to comprise a pair of leg members connected at ends to the catching container with a cross-member between the legs for engaging the horizontal support surface.

13. The dispensing container according to claim 12 wherein the leg members lie along respective sides of the catching container.

14. The dispensing container according to claim 1 wherein the holder portion comprises a panel where the panel contains said plurality of openings forming an array thereon, wherein the panel is arranged behind the blister pack with the blister pack lying against a front surface thereof, wherein the holder portion has at top and bottom edges thereof a slot defined between the panel and an overlying component so that the blister pack lying on the panel has top and bottom edges of the blister pack trapped by the slots, and wherein the panel is open to a first side edge of the panel to allow the blister pack to slide across the front surface of the panel from said first side edge while the top and bottom edges of the blister pack slide in the slots.

15. The dispensing container according to claim 14 wherein the panel has a raised rib along a second side edge to butt against a side edge of the blister pack when in position on the front surface of the panel.

16. The dispensing container according to claim 1 wherein the holder portion comprises a first molded portion defining a front face of the dispensing container at which the blister pack is exposed and the catching container comprises a second molded portion attached to the holder portion behind the holder portion so that the dispensing container is formed wholly by the first molded portion and the second molded portion.

17. A dispensing container for use with a blister pack having a series of blisters each containing a dose of one or more medications which can be expelled from the blisters by a user for use of the medication, the dispensing container comprising:

a holder portion for receiving and supporting the blister pack;

the holder portion having a plurality of openings therein arranged to be aligned with the blisters in the blister pack such that the medication in each blister can be expelled from the blister through the opening;

a catching container fixed to the holder portion adjacent the holder portion such that medication expelled from the blisters through the openings is caught and held in the catching container;

a dispensing opening in the catching container arranged such that the medication caught and held in the catching container is discharged by the user from the catching container through the dispensing opening when required;

wherein the holder portion comprises a panel where the panel contains said plurality of openings forming an array thereon;

wherein the panel is arranged behind the blister pack with the blister pack lying against a front surface thereof;

wherein the holder portion has at top and bottom edges thereof a slot defined between the panel and an overlying component so that the blister pack lying on the panel has top and bottom edges of the blister pack trapped by the slots;

and wherein the panel is open to a first side edge of the panel to allow the blister pack to slide across the front surface of the panel from said first side edge while the top and bottom edges of the blister pack slide in the slots.

18. The dispensing container according to claim 17 wherein the panel has a raised rib along a second side edge to butt against a side edge of the blister pack when in position on the front surface of the panel.

19. The dispensing container according to claim 17 wherein the holder portion comprises a first molded portion defining a front face of the dispensing container at which the blister pack is exposed and the catching container comprises a second molded portion attached to the holder portion behind the holder portion so that the dispensing container is formed wholly by the first molded portion and the second molded portion.

* * * * *